United States Patent [19]

Blair, Jr. et al.

[11] Patent Number: 4,896,125

[45] Date of Patent: Jan. 23, 1990

[54] DIELECTRIC NOTCH RESONATOR

[75] Inventors: William D. Blair, Jr., Lanoka Harbor; Salvatore Bentivenga, Manalapan; Gregory J. Lamont, Englishtown, all of N.J.

[73] Assignee: Alcatel N.A., Inc., Claremont, N.C.

[21] Appl. No.: 284,341

[22] Filed: Dec. 14, 1988

[51] Int. Cl.[4] ..... H01P 7/10

[52] U.S. Cl. ..... 333/219.1; 333/202; 333/230; 333/235

[58] Field of Search ..... 333/202, 208, 210, 212, 333/219, 219.1, 235, 245, 248, 222–233; 331/96

[56] References Cited

U.S. PATENT DOCUMENTS 4,028,652 6/1977 Wakino et al. ..... 333/235

4,241,322 12/1980 Johnson et al. ..... 333/223 X

*Primary Examiner*—Marvin L. Nussbaum

*Attorney, Agent, or Firm*—Mattern, Ware, Stoltz & Fressola

[57] ABSTRACT

A dielectric notch resonator particularly suitable for use in a band reject filter operable at ultra-high frequencies comprises a dielectric resonator and an associated housing which results in a reactance having an imaginary component effectively nulled by a coupling reactance mechanism forming part of the dielectric notch resonator so as to present a relatively low resistive impedance load at a given center frequency and frequencies in a narrow bandwidth thereabout. The coupling reactive mechanism comprises an inductive wire and a serially connected variable capacitor so as to null the reactive component of the dielectric resonator at a particular center frequency and to modify the symmetry of the rejected frequency bandwidth by adjusting the capacitance of the variable capacitor.

38 Claims, 3 Drawing Sheets

FIG. 2
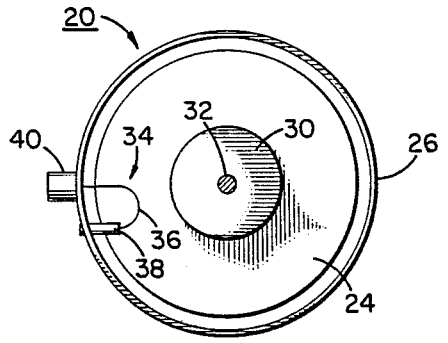
FIG. 1
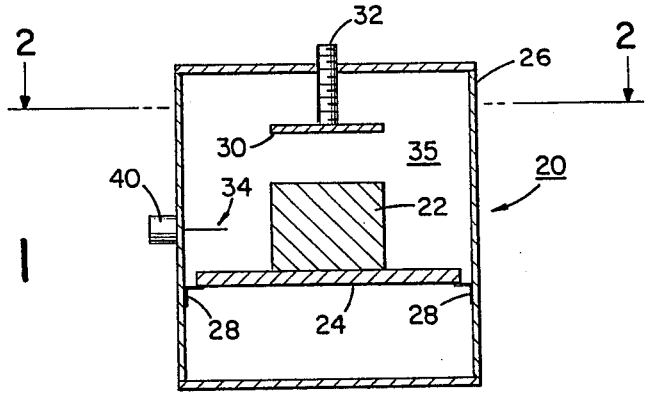
FIG. 3A
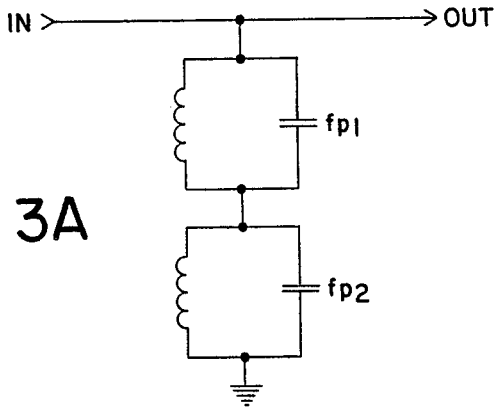
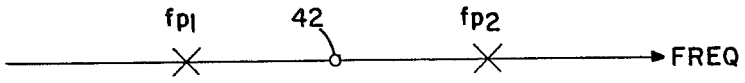
FIG. 3B

DIELECTRIC NOTCH RESONATOR

FIELD OF THE INVENTION

The present invention relates to dielectric notch resonators for attenuating a relatively narrow bandwidth of frequencies with respect to the center frequency being attenuated. Such notch filters are particularly for use in ultra-high frequency (UHF) communication applications such as for cellular telephone communications.

BACKGROUND OF THE INVENTION

Cellular telephone communications have rapidly grown in popularity within the United States. Originally the Federal Communications Commission (FCC) allocated cellular communications over the frequencies of 825–845 megahertz for receive, and 870–890 megahertz for transmit, with a channel bandwidth of 30 kilohertz and a transmit-receive separation of 45 megahertz. Both the transmit and receive bands were originally divided into 10 megahertz sub-bands designated for wireline and non-wireline providers respectively. The wireline service is typically the regional telephone company providing service in a given location while the non-wireline service is provided by any private entrepreneur who through licensing procedures, has been allocated a particular geographic area for cellular communications.

Originally the cellular receive band was divided into two sub-bands 825–835 megahertz for non-wireline and 835–845 megahertz for wireline providers. Within a few years after this allocation of frequencies, it became apparent that more frequency spectrum was required due to the popularity of cellular communications. As a result, the Federal Communication Commission increased the overall receive bandwidth to 824–849 megahertz and the transmit bandwidth to 869–894 megahertz. Due to this expansion of frequencies, the non-wireline receive sub-band was made into two sub-bands, one at 824–835 megahertz and a second at 845–846.5 megahertz. For wireline services, two receive sub-bands were also established, one at the original 835–845 megahertz and a second at 846.5–849 megahertz. Similar dual sub-bands for both non-wireline and wireline services were also established for the transmit band (869–880 megahertz and 890–891.5 megahertz for non-wireline services and 880–890 megahertz and 891.5–893 megahertz for wireline services). Such split frequency allocations have greatly complicated the filtering necessary for cellular communications. The dielectric notch resonator of the present invention addresses this problem by providing a high quality factor (high Q) resonator which through its associated coupling reactance component, effectively presents a low impedance throughout a narrow bandwidth at a desired center frequency so as to be particularly suited for use in notch filter applications.

Although dielectric resonators are well known in the art, the present invention also employs a coupling reactance for generating a low impedance over a narrow bandwidth and for adjusting the symmetry of this bandwidth so as to achieve a uniform low impedance notch to effectively suppress unwanted frequencies.

SUMMARY OF THE INVENTION

A dielectric notch resonator provides a notch or band reject low impedance characteristic over a given frequency bandwidth with the symmetry of the notch resonator adjustable so as to suit a particular filtering application.

Conventional band reject resonators rely upon a coaxial or waveguide type of resonator where the quality factor or Q of such resonators is determined by the conductivity of the materials used in their construction as well as their physical dimensions. As a general rule, the larger the volume of the resonator, the higher the quality factor. The present invention is a dielectric resonator which uses a high dielectric constant material having a low loss so as to greatly reduce the physical dimensions otherwise required so as to obtain a high quality factor band reject resonator for a given frequency range.

The present invention incorporates a dielectric resonator which includes a high dielectric constant ceramic element which is centrally positioned within a conductive cylindrical housing. The ceramic element is placed on a low dielectric, low loss material and has physical dimensions for establishing the approximate frequency of operation. Tuning of the resonator is accomplished through use of conventional conductor disc positioning with respect to the ceramic resonator element.

In addition to the dielectric resonator, the dielectric notch resonator of the present invention incorporates a coupling reactance mechanism which comprises an inductive coupling loop in series with a variable capacitor. A connector mates at the other end with the inductive loop for connection of the dielectric notch resonator to an external coupling transmission element, such as a coaxial cable. The reactance of the coupling mechanism is selected to be equal and opposite to that of the dielectric resonator so that at the desired center frequency, the imaginary impedance components of the respective reactance elements cancel one another, thereby presenting a relatively low resistance at the desired center frequency. The variable capacitor is used to adjust the coupling mechanism reactance so as to allow the dielectric notch resonator to have symmetrical characteristics about the desired center frequency. Thus the dielectric notch resonator can be tuned not only with regard to its frequency of operation, but with regard to the symmetry of its low resistance impedance over a narrow bandwidth about the center frequency. The depth of the resulting attenuation notch, as well as the breadth of the notch, is adjustable by changing the orientation of the coupling wire within the space between the cylindrical housing and the dielectric resonator.

The resulting dielectric notch resonator is therefore particularly suited for band reject filter applications including those associated with cellular telephone communications.

OBJECTS OF THE INVENTION

It is therefore a principal object of the present invention to provide a dielectric notch resonator incorporating a dielectric resonator having a reactance whose imaginary component is effectively canceled through a coupling reactance element so as to present a relatively low resistance load over a narrow bandwidth centered about a desired center frequency.

Another object of the present invention is to provide a dielectric notch resonator of the above description in which the coupling reactance is obtained through the serial combination of an inductive coupling loop and a variable capacitor.

A still further object of the present invention is to provide a dielectric notch resonator of the above description in which the symmetry of the band reject low impedance characteristic of the resonator is adjustable through adjustment of the variable capacitor.

An additional object of the present invention is to provide a dielectric notch resonator of the above description wherein the amount of maximum attenuation at the center frequency and the breadth and sharpness of the band reject bandwidth is adjustable by changing the orientation of the coupling wire within the dielectric notch resonator.

Still other objects of the present invention will in part be obvious and will in part appear hereinafter.

BRIEF DESCRIPTION OF THE DRAWINGS

For a fuller understanding of the nature and objects of the present invention, reference should be made to the following detailed description taken in conjunction with the accompanying drawings, in which:

FIG. 1 is a cross-sectional side elevational view of a dielectric notch resonator according to the present invention;

FIG. 2 is a top cross-sectional view of the dielectric notch resonator taken along line 2—2 in FIG. 1;

FIG. 3A is an equivalent circuit of the dielectric notch resonator;

FIG. 3B is a reactance diagram of the dielectric notch resonator having the equivalent circuit shown in FIG. 3A.

BEST MODE FOR CARRYING OUT THE INVENTION

Figure 4:
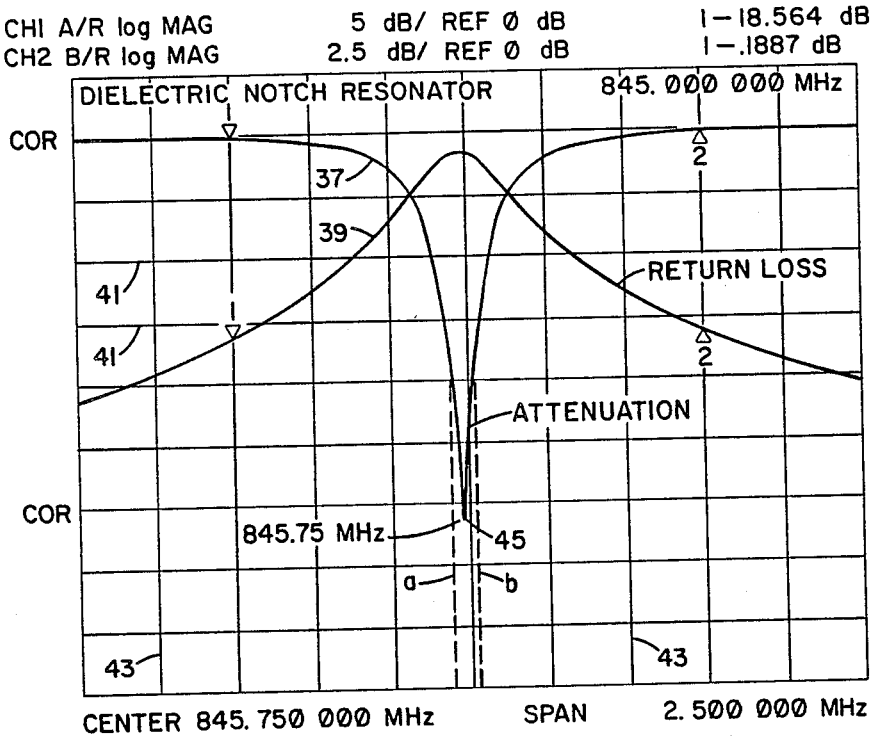
FIG. 4 is a response curve of a particular dielectric notch resonator having a center frequency of 845.75 megahertz showing both the attenuation curve and the return loss curve as function of frequency.

As seen in FIGS. 1 and 2, a dielectric notch resonator 20 comprises a cylindrically shaped dielectric resonator 22 mounted on a low dielectric constant, low-loss platform 24 which in turn is mounted to a cylindrically shaped housing 26 by means of support brackets 28. The dielectric resonator is preferably made from a ceramic material having a high permeability, such as zirconium tin titanate, while the mounting base can be made from a material such as cross-linked polystyrene sold under the Rexolite trademark of the General Electric Company. The cylindrical housing can be formed from any type of conductive material such as aluminum.

For use of the dielectric notch resonator at an operating center frequency of approximately 845 megahertz, the dielectric resonator has an outside diameter of approximately 2.75 inches (6.99 cm) and a height of approximately 1 inch (2.54 cm) while the cylindrical housing has a diameter of 5 inches (12.7 cm) and a height of about 5 inches (12.7 cm).

Fine tuning of the center frequency of the dielectric notch resonator is accomplished through use of a tuning disc 30 made from a conductive material such as copper, with the diameter of this disc approximately the same as the cross-sectional diameter of the dielectric resonator 22. The height of disc 30 with respect to dielectric resonator 22 is adjustable by means of screw 32, which in turn adjusts the center frequency of the resonator.

The resonator as described above without the coupling reactance mechanism described below, has a high reactance at the selected center frequency. This reactance measured in ohms has both a real (that is a resistive) component and an imaginary (that is a 90 degree out-of-phase) component.

In order to show a low real component resistance with little imaginary component, it is necessary that the imaginary component of the dielectric reactance be offset by a 180 degree out of phase imaginary component of another reactance. The result is a dielectric notch resonator with a relatively low, primarily resistive impedance at the center frequency and a narrow bandwidth there about. Such a notch resonator effectively rejects electromagnetic energy within this bandwidth.

The present invention achieves this result through a coupling mechanism 34 which in turn comprises an inductive wire loop 36 and a capacitive element 38. The coupling wire is any type of conductive wire which for the embodiment shown in FIGS. 1 and 2 when operating at a center frequency of approximately 845 megahertz, would have a length of 0.625 inch (1.59 cm) and would have a configuration as best seen in FIG. 2. This coupling wire terminates at one end with connector 40 which in turn can connect to a coupling transmission line such as coaxial cable. The connector is preferably an N-type female bulkhead connector.

The capacitive element is preferably a variable capacitor. In the preferred embodiment of the present invention for operation at a center frequency of 845 megahertz, the capacitor has a range of values of 0.6 to 6 picofarads.

The resultant equivalent circuit for the overall dielectric notch resonator is shown in FIG. 3A, wherein $fp_1$ and $fp_2$ respectively represent the resonator pole frequencies of the coupling mechanism and the dielectric resonator. As shown in FIG. 3B these poles (shown by X's on the frequency ordinate), represent pass frequencies since the impedance is theoretically infinite at each such frequency. According to Foster's Reactance Theorem, there is a zero between the two poles, as designated by numeral 42. This zero is a loss impedance (theoretically zero) which represents the notch center frequency.

FIG. 4 illustrates the attenuation and return loss response curves 37 and 39 for the dielectric notch resonator shown in FIGS. 1 and 2. Curve 37 represents the attenuation of the output signal from the resonator as compared to the input signal. This attenuation is measured in decibels (dB) with each horizontal line 41 representing a change of 2.5 dB for curve 37. Vertical lines 43 each represent a change of 0.25 mhz. It is seen in FIG. 4 that the maximum attenuation at point 45 is 15.75 dB.

Curve 39 in FIG. 4 represents what is known as the return loss of the dielectric notch resonator. By definition, the return loss is:

$$\text{return loss} = 20 \log 1/(\text{abs}(\text{reflection coefficient})),$$

where the reflection coefficient is equal to zero for a perfect match (no reflection at the interface) and is equal to one if the incoming signal is completely reflected back to the source at the interface. For filtering applications, it is desired that the return loss be greater than approximately 15 dB for regions where attenuation is not desired (where filtering is not desired) and be as close to zero where attenuation (filtering) is desired. Horizontal lines 41 for curve 39 are in units of 5 dB.

It is seen in FIG. 4 that over a bandwidth of approximately 0.20 megahertz centered about the 845.75 megahertz center frequency 45 (see dotted lines a and b) the attenuation is at least 10 decibels (dB), with a maximum attenuation of approximately 15.75 dB at the center frequency.

By adjusting capacitor 38, the symmetry of the low impedance reactance of the dielectric notch resonator can be adjusted with respect to the center frequency. Indeed, either symmetrical or non-symmetrical band reject bandwidths are obtainable through variation of capacitor 38. FIG. 4 illustrates a symmetrical band reject bandwidth.

The maximum attenuation at center frequency 45 as well as the slope of attenuation curve 37 is adjustable by altering the orientation of coupling wire 36 within air space 35 (see FIGS. 1 and 2).

It is of course apparent that the physical size of the dielectric notch resonator can be varied to achieve a different center frequency of operation with concomitant variation in the coupling wire loop length and variable capacitor capacitance so as to achieve a high quality factor band reject resonator for virtually any desired center frequency. It is also apparent that the particular materials used for the dielectric resonator, mounting base, and housing can be varied and still achieve the function of a dielectric notch resonator as defined herein if the coupling reactance mechanism is included.

It will thus be seen that the objects set forth above and those made apparent from the preceding description, are efficiently obtained and, since certain changes may be made in the above dielectric notch resonator without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the dielectric notch resonator described herein, and all statements of the scope of the invention which, as a matter of language, might be said to fall therebetween.

Having described the invention what is claimed is:

1. A dielectric notch resonator comprising:

(A) a dielectric resonator formed from a high dielectric constant material;

(B) a housing positioned about the dielectric resonator;

(C) means for positioning the dielectric resonator within the volume defined by the housing so as to generate a resonate reactive impedance about a center frequency; and (D) a coupling reactance mechanism comprising:

(1) an inductive coupling wire, (2) a capacitive element connected to the coupling wire at one end and forming therewith a reactive element having an imaginary impedance component of approximately the same magnitude as the imaginary impedance component of the resonator at the center frequency of the dielectric resonator, with the imaginary component of the coupling mechanism reactance approximately 90 degrees out of phase with that of the dielectric resonator so as to effectively cancel the imaginary reactive component of the resonator reactance at the center frequency and frequencies thereabouts, and (3) means, connected at the second end of the coupling wire, for providing interconnection of the dielectric notch resonator with an external component.

2. A dielectric notch resonator as defined in claim 1, further comprising means for adjusting the center frequency of the resonator.

3. A dielectric notch resonator as defined in claim 2, wherein the capacitor is a variable capacitor and wherein variation of the capacitance of the variable capacitor adjusts the symmetry of the frequency response of the dielectric notch resonator with respect to the center frequency of the dielectric resonator.

4. A dielectric notch resonator as defined in claim 2, wherein the dielectric resonator is formed from a ceramic material.

5. A dielectric notch resonator as defined in claim 3, wherein the dielectric resonator is formed from a ceramic material.

6. A dielectric notch resonator as defined in claim 5, wherein the dielectric resonator is formed from zirconium tin titanate.

7. A dielectric notch resonator as defined in claim 6, wherein the means for positioning the dielectric resonator within the volume defined by the housing is formed from a planar material having a low dielectric constant.

8. A dielectric notch resonator as defined in claim 7, wherein the means for positioning the dielectric resonator within the volume defined by the housing is a formed from cross-linked polystyrene.

9. A dielectric notch resonators defined in claim 8, wherein the dielectric resonator is cylindrical in shape and the housing is cylindrical in shape and approximately 2.75 times the diameter of the dielectric resonator.

10. A dielectric notch resonator as defined in claim 9 for operating at a center frequency of approximately 845 megahertz, wherein the diameter of the dielectric resonator is approximately 1 inch (2.54 cm) and the diameter and height of the housing of the cylindrical housing are both approximately 5 inches (10.7 cm).

11. A dielectric notch resonator as defined in claim 1, wherein the capacitor is a variable capacitor and wherein variation of the capacitance of the variable capacitor adjusts the symmetry of the frequency response of the dielectric notch resonator with respect to the center frequency of the dielectric resonator.

12. A dielectric notch resonator as defined in claim 1, wherein the means for providing interconnection with an external element comprises an N type female bulkhead connector.

13. A dielectric notch resonator as defined in claim 11, wherein the dielectric resonator is formed from a ceramic material.

14. A dielectric notch resonator as defined in claim 13, wherein the dielectric resonator is formed from zirconium tin titanate.

15. A dielectric notch resonator as defined in claim 1, wherein the dielectric resonator is formed from zirconium tin titanate.

16. A dielectric notch resonator as defined in claim 1, wherein the means for positioning the dielectric resonator within the volume defined by the housing is formed from a planar material having a low dielectric constant.

17. A dielectric notch resonator as defined in claim 1, wherein the means for positioning the dielectric resonator within the volume defined by the housing is a formed from cross-linked polystyrene.

18. A dielectric notch resonator as defined in claim 1, wherein the dielectric resonator is cylindrical in shape and the housing is cylindrical in shape and approximately 2.75 times the diameter of the dielectric resonator.

19. A dielectric notch resonator comprising:

(A) a dielectric resonator;

(B) a housing positioned about the dielectric resonator;

(C) means for positioning the dielectric resonator within the volume defined by the housing so as to generate a resonate reactive impedance about a center frequency; and (D) a coupling reactance mechanism comprising:

(1) means for producing an inductive impedance, (2) means for producing a capacitive impedance connected to the inductive impedance means and forming therewith a reactive element having an imaginary impedance component of approximately the same magnitude as the imaginary impedance component of the resonator at the center frequency of the dielectric resonator, with the imaginary component of the coupling mechanism reactance approximately 90 degrees out of phase with that of the dielectric resonator so as to effectively cancel the imaginary reactive component of the resonator reactance at the center frequency and frequencies thereabouts, and (3) means, connected to the reactive element, for providing interconnection of the dielectric notch resonator with an external component.

20. A dielectric notch resonator as defined in claim 19, wherein the means for providing interconnection with an external element comprises an N type female bulkhead connector.

21. A dielectric notch resonator as defined in claim 19, wherein the dielectric resonator is cylindrical in shape and the housing is cylindrical in shape and approximately 2.75 times the diameter of the dielectric resonator.

22. A dielectric notch resonator as defined in claim 19, further comprising means for adjusting the center frequency of the resonator.

23. A dielectric notch resonator as defined in claim 22, wherein the capacitive impedance means is a variable capacitor and wherein variation of the capacitance of the variable capacitor adjusts the symmetry of the frequency response of the dielectric notch resonator with respect to the center frequency of the dielectric resonator.

24. A dielectric notch resonator as defined in claim 23, wherein the dielectric resonator is formed from a material having a high dielectric constant.

25. A dielectric notch resonator as defined in claim 24, wherein the dielectric resonator is formed from a ceramic material.

26. A dielectric notch resonator as defined in claim 25, wherein the dielectric resonator is formed from zirconium tin titanate.

27. A dielectric notch resonator as defined in claim 26, wherein the means for positioning the dielectric resonator within the volume defined by the housing is formed from a planar material having a low dielectric constant.

28. A dielectric notch resonator as defined in claim 27, wherein the means for positioning the dielectric resonator within the volume defined by the housing is a formed from cross-linked polystyrene.

29. A dielectric notch resonator as defined in claim 28, wherein the dielectric resonator is cylindrical in shape and the housing is cylindrical in shape and approximately 2.75 times the diameter of the dielectric resonator.

30. A dielectric notch resonator as defined in claim 29 for operating at a center frequency of approximately 845 megahertz, wherein the diameter of the dielectric resonator is approximately 1 inch (2.54 cm) and the diameter and height of the housing of the cylindrical housing are both approximately 5 inches (10.7 cm).

31. A dielectric notch resonator as defined in claim 19, wherein the capacitive impedance means is a variable capacitor and wherein variation of the capacitance of the variable capacitor adjusts the symmetry of the frequency response of the dielectric notch resonator with respect to the center frequency of the dielectric resonator.

32. A dielectric notch resonator as defined in claim 31, wherein the dielectric resonator is formed from a material having a high dielectric constant.

33. A dielectric notch resonator as defined in claim 32, wherein the dielectric resonator is formed from a ceramic material.

34. A dielectric notch resonator as defined in claim 24, wherein the dielectric resonator is formed from a ceramic material.

35. A dielectric notch resonator as defined in claim 34, wherein the dielectric resonator is formed from zirconium tin titanate.

36. A dielectric notch resonator as defined in claim 19, wherein the dielectric resonator is formed from zirconium tin titanate.

37. A dielectric notch resonator as defined in claim 19, wherein the means for positioning the dielectric resonator within the volume defined by the housing is formed from a planar material having a low dielectric constant.

38. A dielectric notch resonator as defined in claim 19, wherein the means for positioning the dielectric resonator within the volume defined by the housing is a formed from cross-linked polystyrene.

* * * * *